US005295867A

United States Patent [19]

Bethurum

[11] Patent Number: 5,295,867

[45] Date of Patent: Mar. 22, 1994

[54] EDGE CONNECTOR SHIELD

[75] Inventor: Gary C. Bethurum, Laguna Niguel, Calif.

[73] Assignee: ITT Corporation, Secaucus, N.J.

[21] Appl. No.: 996,428

[22] Filed: Dec. 23, 1992

[51] Int. Cl.[5] ..... H01R 9/09

[52] U.S. Cl. ..... 439/607; 439/79; 439/108

[58] Field of Search ..... 439/79, 59, 607, 609, 439/92, 101, 108

[56] References Cited

U.S. PATENT DOCUMENTS

| | | | |
|---|---|---|---|
| 4,221,458 | 9/1980 | Hughes et al. . | |
| 4,290,101 | 9/1981 | Hergenhan | 363/65 |
| 4,685,039 | 8/1987 | Inou et al. | 363/16 |
| 4,772,224 | 9/1988 | Talend | 439/607 |
| 4,814,965 | 3/1989 | Petersen | 363/65 |
| 4,842,554 | 6/1989 | Cosmos et al. | 439/609 |
| 4,898,546 | 2/1990 | Elco et al. | 439/608 |
| 4,959,024 | 9/1990 | Czeschka | 439/607 |
| 4,959,024 | 9/1990 | Czeschka | 439/607 |
| 4,972,292 | 11/1990 | Petersen | 361/56 |
| 5,035,631 | 7/1991 | Piorunneck et al. | 439/108 |
| 5,037,330 | 8/1991 | Fulponi et al. | 439/607 |
| 5,067,914 | 11/1991 | Seidel et al. | 439/609 |
| 5,083,945 | 1/1992 | Miskin et al. | 439/108 X |
| 5,088,017 | 2/1992 | Yaginuma et al. | 363/21 |
| 5,105,351 | 4/1992 | Harada et al. | 363/65 |
| 5,141,445 | 8/1992 | Little | 439/108 |
| 5,161,999 | 11/1992 | Broschard, III et al. | 439/607 X |

*Primary Examiner*—Larry I. Schwartz
*Assistant Examiner*—Khiem Nguyen
*Attorney, Agent, or Firm*—Thomas L. Peterson

[57] ABSTRACT

A shield is provided for placing around an edge connector that is mounted near the edge of a circuit board, which can be readily mounted on the board. The shield (36, FIG. 2) includes an arm (72) with an outer part (74) that extends down along the outer board edge (70), and an arm inner part (76) that extends inwardly below the board lower surface (46) and that has a clamp end (80) that presses up against the board to thereby clamp the shield to the board without the need to drill holes or the like in the board. The board has a grounded conductive trace (50) on its upper surface, and the shield is formed of sheet metal with tabs (52, 54, 56) at its lower ends which extend horizontally and slightly below the rest of the shield sides, to press directly against the grounded trace on the board. The arm which has an inner part below the board, can include a 90° bend (140, FIG. 5) so that the sheet metal inner arm part (142) lies primarily in a horizontal plane. With the connector contacts having tails with inclined portions (161–164, FIG. 6), the back side of the shield can have an inclined portion (172) at the same angle (A) as the inclined portions of the contact tails (154).

12 Claims, 4 Drawing Sheets

EDGE CONNECTOR SHIELD

BACKGROUND OF THE INVENTION

An edge connector is commonly mounted on an edge portion of a circuit board, to enable that circuit board to be connected to another circuit board. In one arrangement, a main circuit board or mother board, has a plurality of open connecters on one of its surfaces, and each of several daughter boards has an edge connector which can mate with one of the connectors on the mother board.

It is common to provide a metal shield, usually of sheet metal, around each connector to provide for electrostatic discharge and to guard against radio frequency interference. It is common to form each shield with depending pin portions which project through grounded plated-through holes in the circuit board, so as to mount the shield on the board and to ground the shield. The need to drill holes in the circuit board, and possibly to plate such holes, adds to the expense of the connector assembly. In some cases, the connector is initially designed without a shield, and it would be desirable if a shield could be retrofitted to the connector and board without having to drill holes in the board. In some cases, the connector is surface mounted so it does not require holes in the board, and it is desirable to enable the shield to be mounted without holes. Thus, a shield for static discharge and electromagnetic interference protection, which could be readily mounted on the edge portion of a circuit board around an edge connector thereon, without the need for the drilling and/or electroplating of board holes to hold and ground the shield, would be of value.

SUMMARY OF THE INVENTION

In accordance with one embodiment of the present invention, an edge connector shield is provided, which can be readily mounted on a circuit board. The shield has a top portion and has sides extending downwardly to the board, with opposite lateral side portions including an arm for clamping to the edge portion of the board. Each arm has an outer arm part that extends down along the board edge to below the board, and an arm inner part that extends inwardly below the board lower surface. The arm inner part has a clamp end positioned to press up against the board lower surface to thereby clamp the shield to the board. The board has a grounded conductive trace on its upper surface. The shield is formed of sheet metal and has at least one tab at its lower end extending horizontally from the lower end and slightly below adjacent portions of the shield, and lying on top and against the grounded trace. Thus, the shield can be clamped to the board and its tabs held against grounded traces on the board, without the need for drilling holes in the board.

The arm can include a 90° bend at the bottom of the arm outer part, so the sheet metal arm inner part lies largely in a horizontal plane. This can reduce the thickness of the arm lying below the lower surface of the board, and increase the resilience of the arm.

The connector includes an insulative body with contacts that can have tails extending inwardly and downwardly to the circuit board. Each tail has an inclined portion extending at an angle of between about 30° and 60° from the horizontal. The shield back side can have a correspondingly incline portion to provide uniform impedance characteristics for the contacts.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
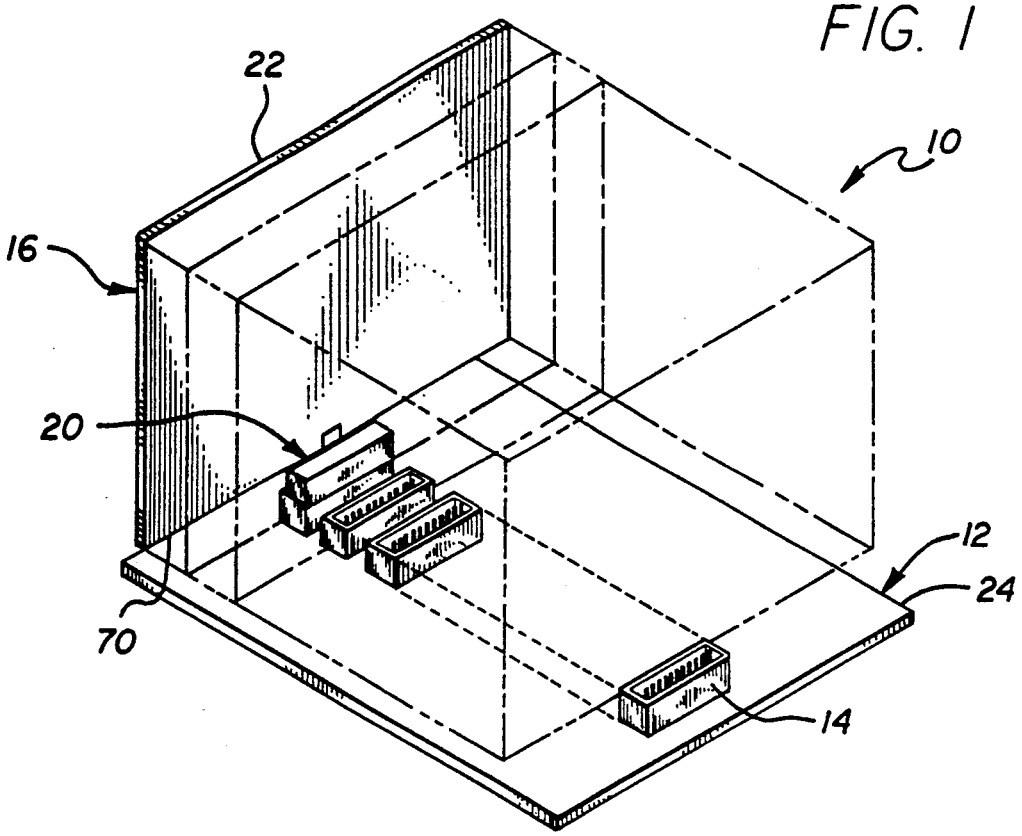
FIG. 1 is an isometric view of a board assembly constructed in accordance with one embodiment of the present invention.
Figure 2:
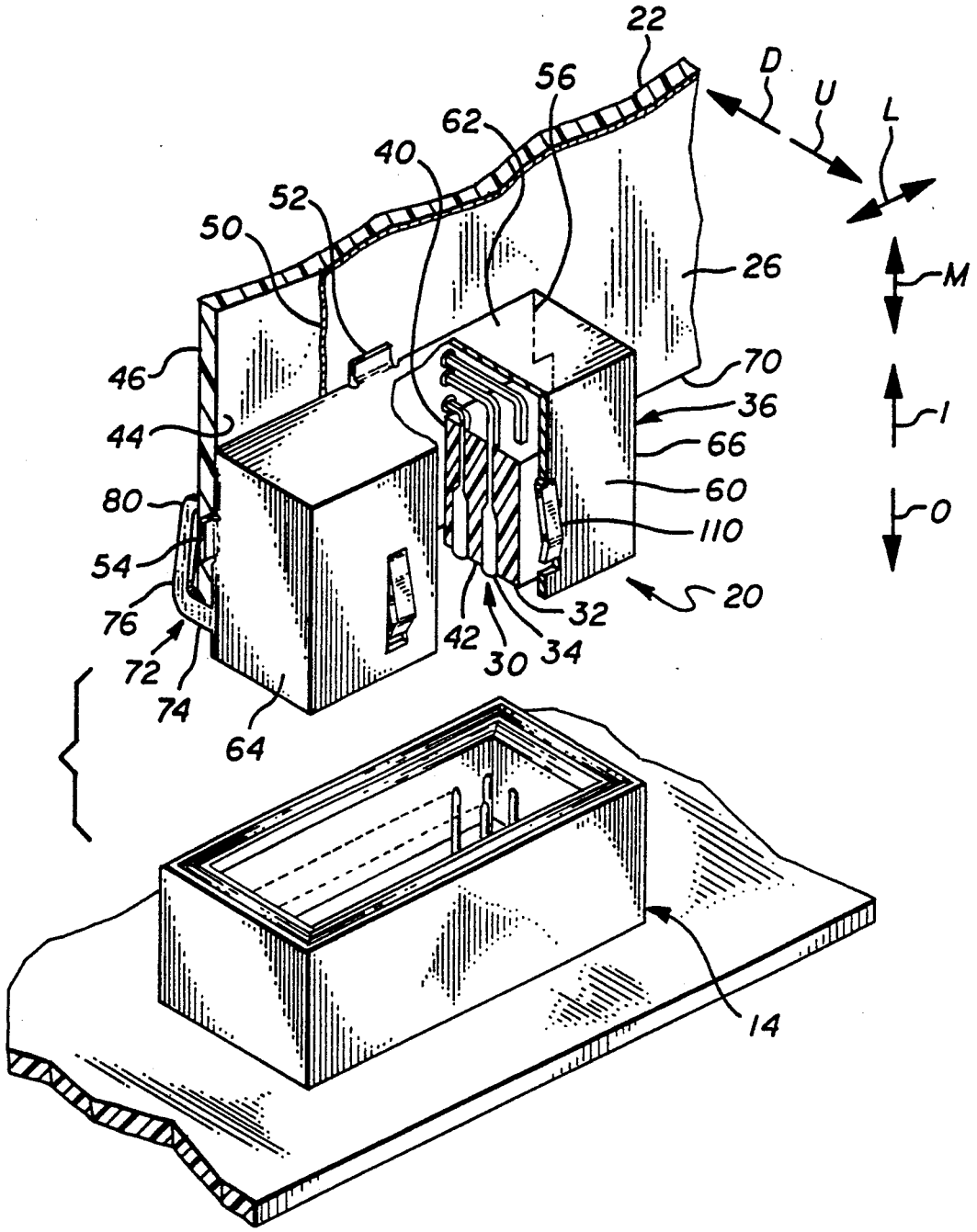
FIG. 2 is a partial and partially sectional exploded isometric view of a connector arrangement of the board assembly of FIG. 1.

FIG. 1 illustrates a board assembly 10 which includes a mother board 12 having a plurality of mother board connectors 14. A plurality of daughter boards 16 each has an edge connector assembly 20 on its outer edge portion 70, which plugs into one of the mother board connectors 14, to connect a circuit board 22 of the daughter board to the circuit board 24 of the mother board. FIG. 2 illustrates some details of one of the edge connector assemblies 20 which lies on an edge portion 26 of the daughter circuit board 22. The connector assembly includes an edge connector 30 having an insulative body 32 and multiple contacts 34 secured in the body. The assembly also includes a shield 36 which surrounds the edge connector except for the bottom 40 which faces the circuit board 22, and the outer end 42 which mates with the mother board connector.

To facilitate the description of the invention, applicant describes the orientation and directions by arrows, including inner and outer directions indicated by arrows I and 0, lateral and longitudinal directions indicated by arrows L and M, and up and down directions indicated by arrows U and D. Also, applicant uses terms such as "horizontal" and "vertical". However, it should be understood that the parts of the invention can be used in any orientation with respect to gravity.

The circuit board 22 has upper and lower surfaces 44, 46, with at least the upper surface 44 having a grounded conductive trace or ground plane 50 thereon. The trace may cover most of the upper surface of the board, or may cover only a limited area, to engage tabs 52–56 of the shield. The shield is constructed of sheet metal, has a top portion 60 spaced above the circuit board, and has sides 62–66 extending downwardly to the board. The sides include a back side 62 spaced inwardly (in direction I) from the board outer edge 70, and includes lateral sides 64, 66 which extend in inward and outward directions (I, 0) and projects outwardly beyond the board outer edge 70.

Figure 3:
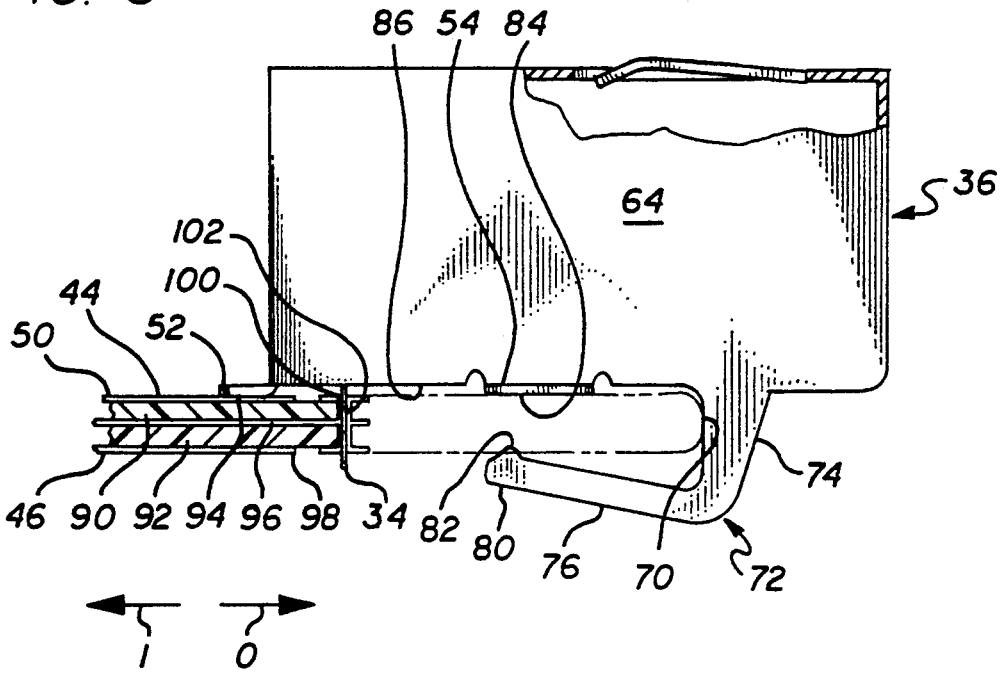
FIG. 3 is a partially sectional left side view of the edge connector assembly of the arrangement of FIG. 2.

In accordance with the present invention, each of the shield opposite lateral sides such as 64, best shown in FIG. 3, includes an arm 72 having an outer arm part 74 positioned on the lateral side to extend down along the board outer edge 70 to below the board lower surface or face 46. The arm also includes an inner part 76 that extends inwardly, largely along direction I, below the board lower surface. The arm inner part has a clamp end 80, with a clamping protuberance 82 that presses up against the board lower surface, to clamp the shield to the board.

The clamp end 82 of the clamp arm 72, preferably lies between parts of the rear and side tabs 52, 54. This urges all tabs 52-56 against the board, to avoid tilting of the shield which would raise the rear tab 52 above the board.

The tabs such as 54 at the bottom of the shield sides, have lower surfaces 84 that extend slightly lower than the lower edges 86 of the rest of the shield sides. This assures that downward pressure of the shield on the upper surface of the circuit board, will occur at the tabs 52-56. This results in good pressure contact of each of the tabs with the grounding trace 50 on the upper surface of the circuit board. It should be noted that there are a variety of circuit board constructions, with a particular construction shown in FIG. 3 including two board sheets 90, 92 and three planes 94, 96, and 98. The center plane 96 carries primarily signal traces, which are generally at a potential different than ground, while the upper and lower planes 94, 98 are covered primarily with a ground plane which is at ground potential. The contacts 34 have tails 100 which may project through plated-through holes 102 in the circuit board which are connected to traces of the center plane. However, other connectors are primarily surface mounted types, wherein the ends of the tails do not project into holes but lie against and may be soldered to traces on the upper surface of the board. Other circuit board arrangements include a ground plane covering only a portion of the upper surface of the board, and with most of the upper surface area covered by signal traces.

Figure 4:
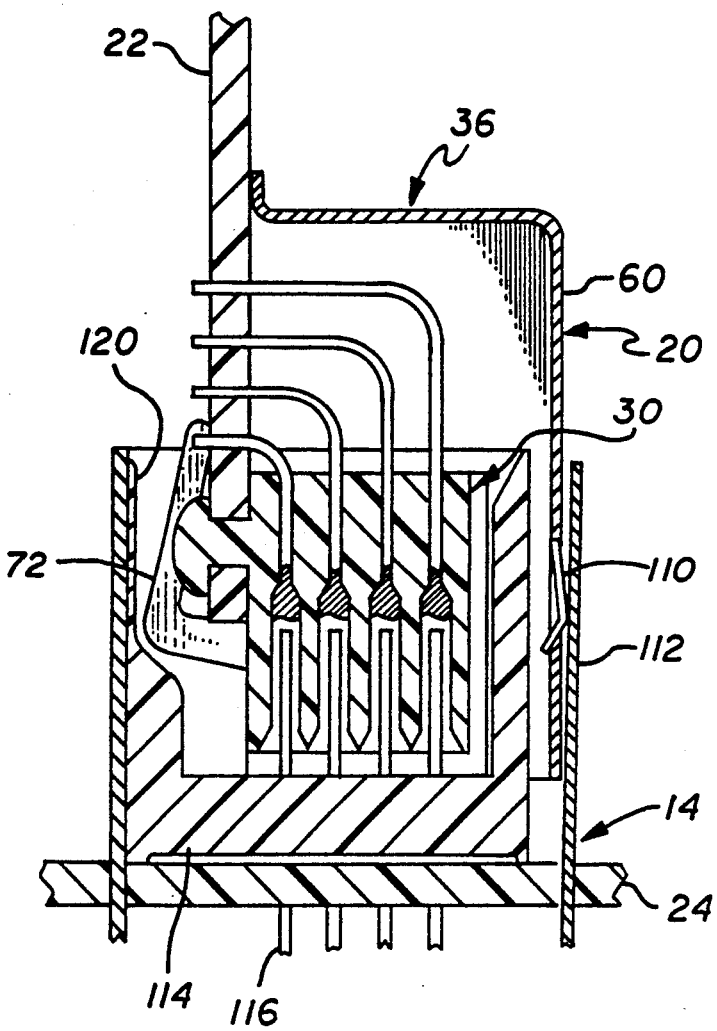
FIG. 4 is a sectional view of the connector arrangement of FIG. 2, with the connector assemblies fully mated.

FIG. 4 shows the edge connector assembly 20 and mother board connector assembly 14 fully mated. Grounding fingers 110 on the top portion 60 of the shield press against a corresponding wall 112 on the mother board connector shield. The mother board connector assembly includes an insulative body 114 which carries contacts 116 that mate with the corresponding contacts of the edge connector 30. It may be noted that the mother board insulative body 114 has a recess 120 for receiving the arm 72 of the edge connector assembly shield 36.

Figure 5:
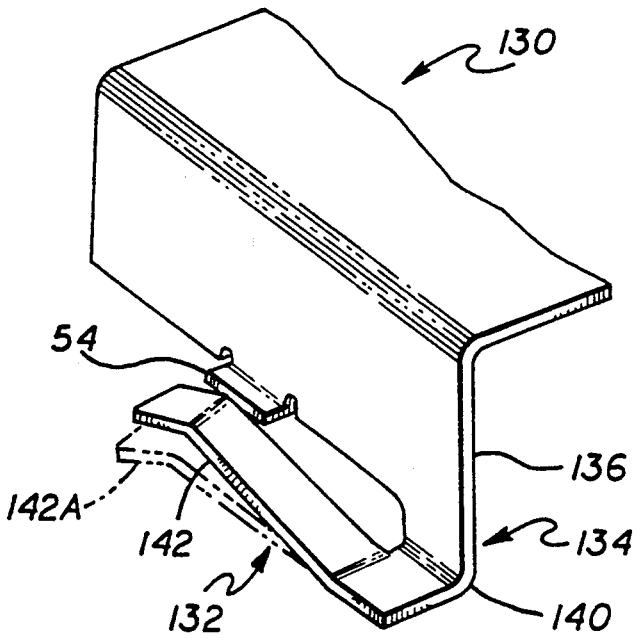
FIG. 5 is a partial isometric view of a shield constructed in accordance with another embodiment of the invention.

FIG. 5 illustrates a shield 130 similar to that of FIGS. 1-4, except that the arm 132 has a different construction. The arm outer part 134 includes a first portion 136 extending in a vertical plane, and includes a substantially 90° bend 140 at the bottom of the first portion, which positions most of the arm inner part 142 in a primarily horizontal plane. The figure shows the inner arm part at 142A in a deflected position which it assumes when installed on a circuit board. The advantage of the bend 140 resulting in a primarily horizontal sheet metal inner part 142, is that it results in an arm of greater flexibility and which lies a smaller distance below the lower surface of the circuit board on which the shield is mounted. By having the arm extend a smaller distance below the circuit board, the recess (120 in FIG. 4) for receiving the arm, does not have to be as deep.

Figure 6:
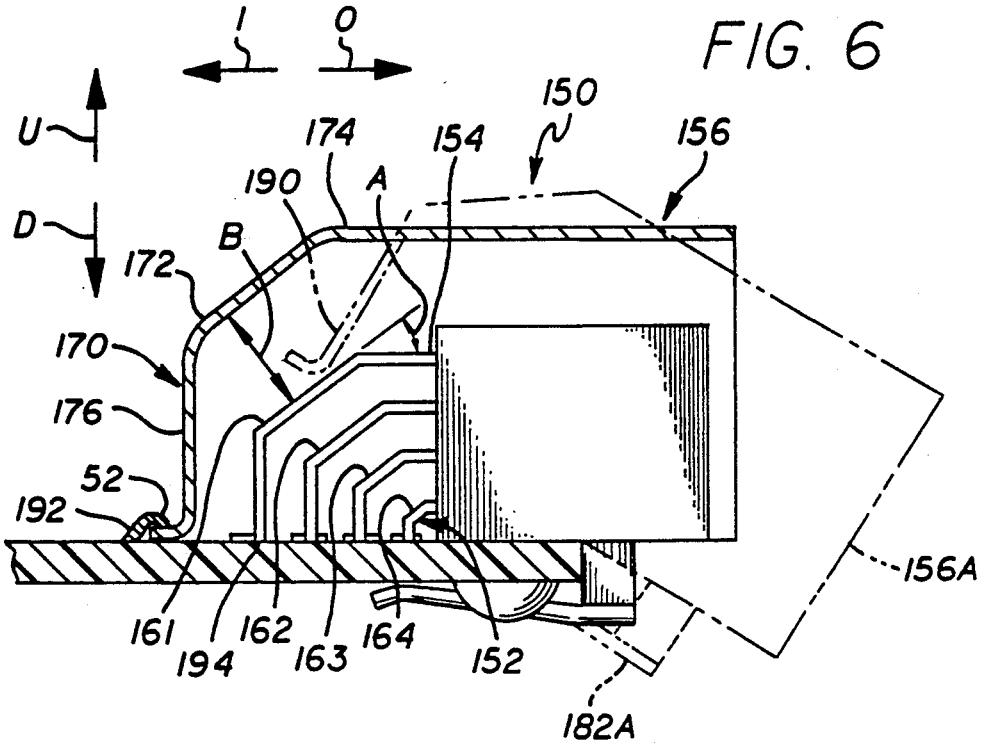
FIG. 6 is a sectional left side view of an edge connector assembly constructed in accordance with another embodiment of the invention, and shown mounted on a circuit board.
Figure 7:
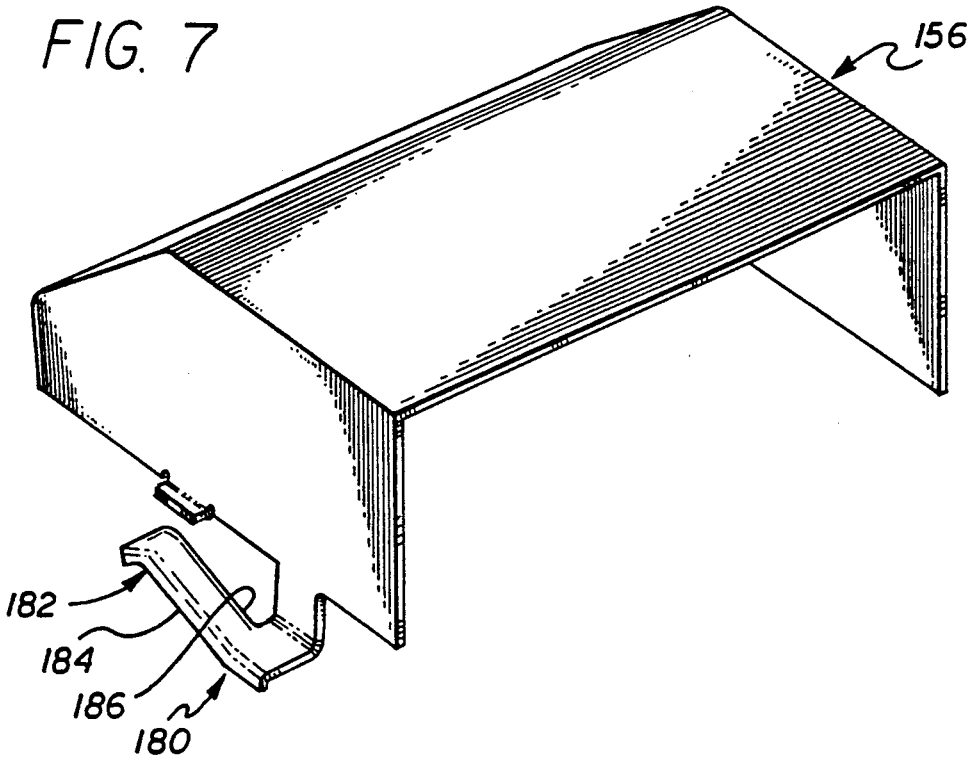
FIG. 7 is an isometric view of the shield of the connector assembly of FIG. 6.

FIGS. 6 and 7 illustrate another edge connector assembly 150, wherein the contacts 152 of the edge connector include tails 154 designed to provide a substantially constant characteristic impedance for the connector. Instead of the tails being bent along a large radius of curvature, the tails have sharp bends, which result in inclined portions 161-164 for four rows of tails of four corresponding rows of contacts. The tails, including the inclined portions 161-164, are uniformly spaced apart in the inward-outward direction I, O, as well as in horizontal and vertical directions. This type of tail arrangement has been previously invented. Applicant forms the shield back side 170 so it includes an inclined portion 172 which extends parallel to the incline portions 161-164 of the contact tails. The angle A of incline of the tails from the horizontal direction (along which the outermost portions of the tails extend) is preferably between about 30° and 60°, and the back side incline portion 172 extends at this angle. In addition, the top and back portions 174, 176 of the shield extend parallel to corresponding portions of the tails, and all shield portions are spaced a uniform distance B from the tails. The distance B is preferably about twice the spacing between adjacent rows of tails.

As shown in FIG. 7, the shield 156 has arms 180 similar to those of FIG. 5. However, applicant constructs the inner arm part 182 with bent-over edge portions 184, 186 that extend largely vertically, to somewhat increase the stiffness of the inner arm part. Because of the considerable horizontal width of the inner arm part 182, the bent over edges have to extend only a small distance downwardly to provide an arm about as stiff as the completely vertical arm of FIGS. 1-4.

The shield can be installed, as shown at 156A in FIG. 6, by tipping it with the bottom of the back side at 190 close to the tails 154 of the topmost-innermost row of tails, and with the arm inner end 182A considerably bent downwardly. The shield is then tipped more towards the horizontal and pushed inwardly, until it attains the position shown in solid lines in FIG. 6. In some cases, the back tab 52 is soldered to the ground plane as shown at 192, although in some cases, contact with the ground trace can be established solely by pressure. It may be noted that the lower ends 194 of the tails are shown merely touching signal traces on the board and soldered thereto, rather than extending through holes in the board.

Thus, the invention provides a shield for placing around an edge connector, either at about the same time as installation of the edge connector or as a later retrofit, which enable easy and low cost installation of the shield. The shield has sides, including opposite lateral sides that each forms an arm. The arm has an outer part positioned to extend down along the outer edge of the board, and an inner part that extends inwardly and is biased upwardly against the lower surface of the board to clamp the shield to the board. The sides of the board include at least one, and preferably a plurality of tabs, and the tabs preferably extend slightly below the rest of the lower edge of the shield sides to provide good contact with one or more ground traces on the upper surface of the board. The clamp end of the arm inner part, which presses against the lower surface of the board, preferably lies in an inward-outward direction, between part of the back tab and part of the side tabs, to avoid a tendency to tilt the shield but instead encourage all tabs to press down against the board. The arm of the sheet metal shield can be formed with a first portion at the outer arm part, which extends in a vertical plane, with the arm including a substantially 90° bend so that the inner arm part extends largely in a horizontal plane instead of a vertical one. Where the tails of the edge connector contacts have inclined portions that extend at an incline from the horizontal, applicant prefers to construct the rear side of the shield so it includes an inclined portion extending parallel to the tail inclined portions.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A shield for placing around an edge connector that is permanently mounted on an outer edge portion of a circuit board that has an outer edge, wherein the board has upper and lower surfaces, and wherein said shield has a top portion spaced above said board upper surface and sides extending downwardly to aid board, and including opposite lateral sides extending in directions toward and away from said board outer edge, characterized by:

each of said opposite sides includes an arm having an outer arm part extending down from a lower edge of one of the corresponding opposite lateral sides along said board edge to below said board lower surface, and having an arm inner part that extends inwardly below the board lower surface and that has a clamp end positioned to press up against the board lower surface, to thereby clamp said shield to said board.

2. The shield described in claim 1 wherein:

said board has a grounded conductive trace on said upper surface;

said shield is formed of sheet metal and said sides have lower ends, with at least one tab extending horizontally from said lower end to lie on top of and against said trace.

3. The shield described in claim 2 wherein:

said shield sides include a back side extending largely parallel to said board outer edge and said pair of lateral sides extend perpendicular to said back side toward said board edge;

said at least one tab includes a back tab on the bottom of said back side and a side tab on the bottom of each of said lateral sides;

said board has an outer edge and each of said clamp ends lies a distance from said outer edge which is less than part of said back tab and greater than part of each of said side tabs.

4. The shield described in claim 1 wherein:

said arm outer part includes a first portion extending in a vertical plane and including a substantially 90° bend at the bottom of said first portion which positions most of said arm inner part in a primarily horizontal plane.

5. The shield described in claim 1 wherein:

said connector includes an insulative body and a plurality of contacts having tails extending inwardly and downwardly to said board, each contact tail having a straight inclined portion with all inclined portions extending at the same predetermined angle from the horizontal;

said shield sides include a back side lying largely inward of said contact tails and having an inclined portion extending parallel to said contact inclined portions;

said board has an outer edge and said tails lie in at least three rows with each row of tails extending parallel to said board outer edge, with the inclined portions o different rows uniformly spaced apart by a predetermined distance;

said shield back side is spaced from the closest tail inclined portion, by about twice said predetermined distance.

6. A board-connector assembly, comprising:

a circuit board having upper and lower surfaces and an edge portion with an outer edge that lies outward of the rest of the board, and having a ground plane that includes a grounded conductive trace on said upper surface;

an edge connector which includes an insulative body mounted on said upper surface of said board at said edge portion thereof, and having a plurality of contacts with mating ends extending in an outward direction;

a sheet metal shield which has a top lying above said connector and sides extending down to said circuit board, with said sides having lower ends connected to said conductive trace;

said shield forming an arm with an outer arm part extending down from one of said side lower ends to below the level of said board lower surface and an inner arm part extending inwardly and at an upward incline against substantially said board lower surface to clamp said shield to said board.

7. The assembly described in claim 6 wherein:

said outer arm part lies primarily in a vertical plane, said arm has a lower end forming a largely 90° bend, and said inner arm part comprises a portion of said sheet metal with most of said inner arm sheet metal portion lying in a plane that is primarily perpendicular to said vertical plane.

8. The assembly described in claim 6 wherein:

said shield is mounted to said board independently of said connector, said shield having a plurality of horizontal tabs at the lower ends of said sides which rest on and which are soldered to said grounded conductive trace.

9. A shield for placing around an edge connector that is mounted on an edge portion of a circuit board, wherein the board has upper and lower surfaces, and wherein said shield has a top portion spaced above said board upper surface and sides extending generally downwardly and to said board, including opposite lateral sides extending primarily in a lateral direction toward and away from said board edge and a back side extending primarily parallel to said board edge and lying further from said edge than said connector, and wherein said connector includes an insulative body and a plurality of contacts mounted thereon, wherein said contacts have tails extending inwardly and downwardly to said board, wherein each contact tail has an inclined portion with all contact tail inclined portions extending at the same predetermined incline angle which is between about 30° and 60° from the horizontal, characterized by:

said board has an outer edge, and said tails lie in a plurality of rows that extend parallel to each other with said rows extending substantially parallel to said outer edge, with the tail inclined portions of different rows being uniformly spaced apart by a predetermined distance;

said back side of said shield has an inclined portion extending parallel to said contact tail inclined portions when said shield is mounted on said circuit board, with said shield back side inclined portion being spaced from the closest tail inclined portions by about twice said predetermined distance.

10. The shield described in claim 9 wherein:

each of said opposite lateral sides includes an arm having an outer arm part positioned to extend down along said board edge to below said board lower surface, an with an arm inner part that extends inwardly below the board lower surface and that has a clamp end positioned to press up against the board lower surface, to thereby clamp said shield to said board.

11. A method for shielding an edge connector that lies on the edge portion of a circuit board which has upper and lower board surfaces and an outer edge, comprising:

forming a sheet metal shield with top and side walls including opposite lateral sides, and with an open outer portion, with the sides having lower ends lying in substantially a common plane substantially at the upper surface of the circuit board;

said step of forming including forming arms at inner portions of said lateral sides with each arm having an outer part extending from a lower edge of the corresponding one of said opposite lateral sides and below said common plane and an inner arm part extending primarily inwardly;

installing aid shield including placing said shield over said connector in a tilted orientation, with said inner arm parts under said board, and turning and inwardly shifting said shield until said arm outer parts substantially abut said board edge.

12. The method described in claim 11 wherein said board upper surface has a grounded trace, and wherein:

said step of forming includes leaving a plurality of tabs at the bottom of said side walls and bending said tabs to lie in substantially said common plane, with said tabs positioned to lie on portions of said grounded trace.

* * * * *